US008704088B2

(12) United States Patent
Frey

(10) Patent No.: US 8,704,088 B2
(45) Date of Patent: Apr. 22, 2014

(54) ELECTRICAL CONNECTING CABLE

(75) Inventor: Michael Frey, Enzklösterle (DE)

(73) Assignee: Coninvers GmbH, Herrenberg (DE)

( * ) Notice: Subject to any disclaimer, the term of this patent is extended or adjusted under 35 U.S.C. 154(b) by 231 days.

(21) Appl. No.: 13/283,722

(22) Filed: Oct. 28, 2011

(65) Prior Publication Data

US 2012/0103647 A1 May 3, 2012

(30) Foreign Application Priority Data

Nov. 2, 2010 (DE) ..... 20 2010 014 872 U

(51) Int. Cl.
*H01B 7/00* (2006.01)

(52) U.S. Cl.
USPC ..... 174/36

(58) Field of Classification Search
USPC ..... 174/102 R, 103, 106 R, 109, 110 R
See application file for complete search history.

(56) References Cited

U.S. PATENT DOCUMENTS

| | | | | |
|---|---|---|---|---|
| 3,646,502 | A | 2/1972 | Hutter et al. | |
| 3,805,218 | A | 4/1974 | Voida | |
| 5,142,100 | A | 8/1992 | Vaupotic | |
| 5,349,133 | A * | 9/1994 | Rogers | 174/36 |
| 5,862,030 | A * | 1/1999 | Watkins et al. | 361/103 |
| 6,655,016 | B2 * | 12/2003 | Renaud | 29/825 |
| 7,525,046 | B2 * | 4/2009 | Yang | 174/113 R |
| 7,530,847 | B2 | 5/2009 | Siems | |
| 2005/0199412 | A1 * | 9/2005 | Ke et al. | 174/108 |

FOREIGN PATENT DOCUMENTS

| | | |
|---|---|---|
| DE | 21 38 592 A | 3/1972 |
| DE | 42 14 380 A1 | 12/1992 |
| DE | 11 2007 002 968 T5 | 10/2009 |
| EP | 1848006 A2 | 10/2007 |

OTHER PUBLICATIONS

German Search Report for corresponding German Application No. 20 2010 014 872.3 Issued Jul. 7, 2011.

* cited by examiner

*Primary Examiner* — William H Mayo, III
(74) *Attorney, Agent, or Firm* — Renner, Otto, Boisselle & Sklar, LLP

(57) ABSTRACT

An electrical connecting cable with a flexible electrical cable and with at least one electrical plug connector at one end of the cable, with the electrical cable including a bundle of conductors consisting of insulated stranded wires, a foil shield enclosing the bundle of conductors, and a protective sheath encasing the foil shield and serving as the outer surface of the cable. The plug connector includes a metallic plug connector housing, preferably a round housing, holding insulated contacts and a molded-on shield sleeve with which the stranded wires and the foil shield are connected in an electrically conductive manner. The foil shield includes at least one electrically conductive shield tape and the protective sheath includes at least one electrically non-conductive sheath tape that are both wrapped at an angle spiral-like with a lateral overlap along the stranded wires around the bundle of conductors and the shield sleeve.

6 Claims, 1 Drawing Sheet

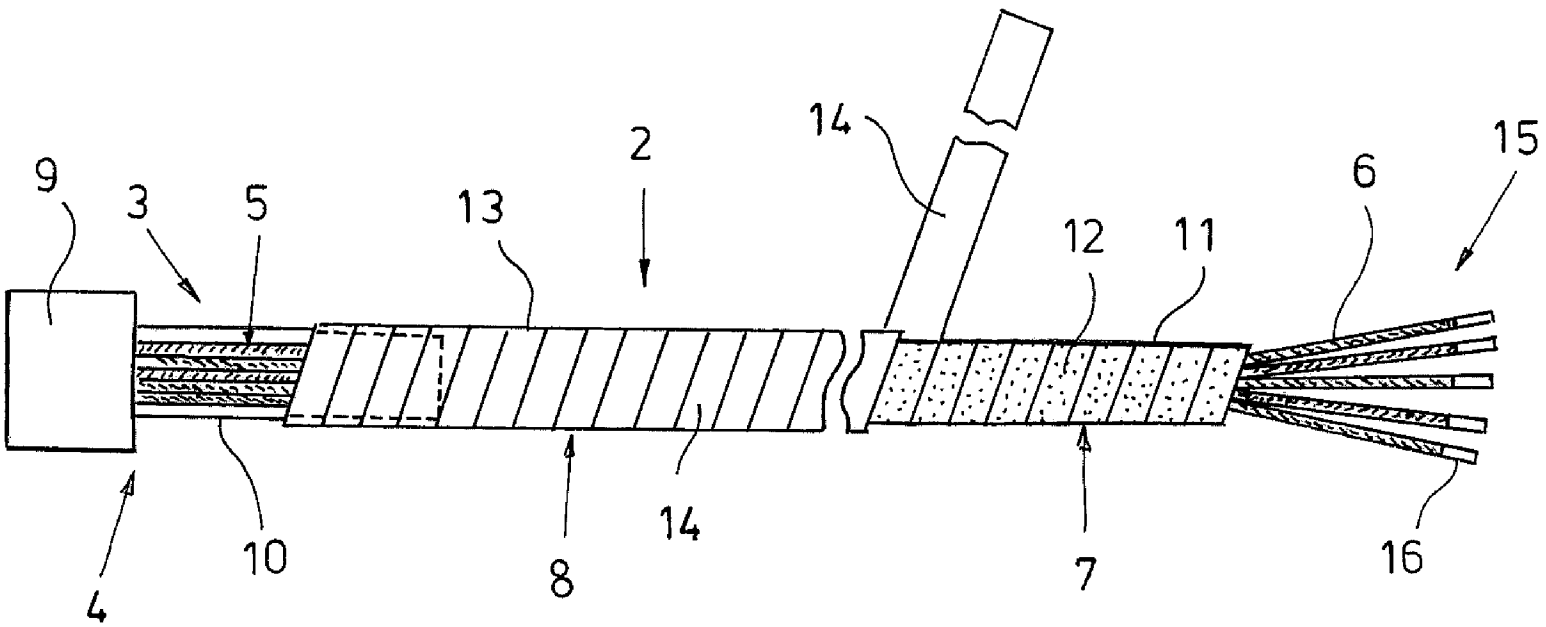
15
6
16
11
12
7
14
2
14
8
13
5
10
3
4
9

ELECTRICAL CONNECTING CABLE

CROSS-REFERENCE TO RELATED APPLICATION

The present application claims priority under 35 USC §119 to German Patent Application No. 20 2010 014 872.3 filed Nov. 2, 2010, the entire disclosure of which is incorporated herein by reference.

TECHNICAL FIELD OF THE INVENTION

The invention relates to an electrical connecting cable with a flexible electrical cable and with at least one electrical plug connector at one end of the cable, with the electrical cable including a bundle of conductors including insulated stranded wires, a foil shield enclosing the bundle of conductors, and a protective sheath encasing the foil shield and serving as the outer surface of the cable, and with the plug connector including a metallic plug connector housing holding insulated contacts and a molded-on shield sleeve with which the stranded wires and the foil shield are connected in an electrically conductive manner.

DESCRIPTION OF THE RELATED ART

Cables with at least one shielded plug connector and at least two shielded electrical conductors of insulated stranded wires are known from the prior art as flexible connecting cables in a wide variety of embodiments. Among others, connecting cables of this type are used to provide, for electrically operated devices with a housing, an electrical interface on the surrounding housing that is accessible from the outside. When used in this way, the plug connector is usually arranged in fixed position at an opening of the housing, with the electrical cable electrically connecting the plug connector and the components installed in the housing.

It is also known to use such connecting cables with industrial devices in an industrial environment, for example control devices or similar equipment. The industrial use involves stricter requirements regarding resistance to EMV interference. In order to reliably prevent the emission or the reception of interfering electromagnetic fields from cables carrying a current, it is common practice to surround electrical cables with a grounded jacket, for example in the form of a conductive foil shield, and to enclose the same in a surrounding protective jacket that protects the foil shield. During the production of the connecting cable, the mechanical and electrical connection of the stranded wires with the contacts is usually accomplished by means of typical methods known from the prior art, i.e. usually by means of clamping, soldering, or crimping. This type of connection is usually sufficient to ensure the transmission of tensile forces and to prevent the conductors carrying the current from becoming detached from the contacts. Normally, special tension relief measures are not required. The foil shield is connected mechanically and electrically with a shield sleeve of the housing of the electrical plug connector in a similar way.

For the production of such connecting cables it is common to use ready-made electrical cables comprising a bundle of conductors consisting of at least two insulated stranded wires, a foil shield enclosing the bundle of conductors, and a hose-like protective sheath made of synthetic material that encases the foil shield and serves as the outer surface of the cable. When conventional fixed-length cables are used, the attachment of the foil shield to common plug connectors is a costly problem. In particular, the shielding that is often glued to the insulation of the stranded wires is difficult to cut without damaging the insulation of the stranded wires. In addition, in order to automatically connect the foil shield to the shield sleeve of the plug connector by means of crimping, the foil shield must usually be placed over the protective sheath of the electrical cable. This increases the time required for the assembly, and therefore also the assembly costs. Furthermore, the production of the electrical connecting cable is generally a time-consuming process and limits the rate at which the cable can be produced. Besides the not fully-automated production process, the relatively high individual cost of the ready-made cable is another obstacle when it comes to providing a connecting cable at reasonable cost.

SUMMARY OF THE INVENTION

The invention addresses the problem of proposing a typical electrical connecting cable that offers improvements in terms of production cost and production technology, is suitable especially for a fully automated mass production, and still ensures a reliable connection.

According to the invention, this problem is solved by an electrical connecting cable as described herein. Preferred embodiments of the connecting cable are specified in the related claims.

The invention is based on using—instead of a ready-made electrical cable comprising a bundle of conductors consisting of insulated stranded wires, a foil shield enclosing the bundle of conductors, and a protective sheath encasing the foil—a number of automatically prefabricated insulated stranded wires with attached contacts, to form these into a bundle of conductors after connecting them to the at least one electrical plug connector, to then enclose the bundle of conductors in the foil shield in a fully automated process, and finally to encase the foil shield in a protective sheath in the same way.

In order to make this possible, the foil shield of the electrical connecting cable according to the invention includes at least one shield tape and the protective sheath includes a sheath tape, the tapes being wrapped spiral-like at an angle along the stranded wires and with a lateral overlap around the bundle of conductors and the shield sleeve. The shield tape and the sheath tape may be wrapped in time-parallel or time-serial fashion around the bundle of conductors and around the shield sleeve that is molded onto the metallic plug connector housing, for example a round housing. This supposes that the shield tape is first wound partially or completely, preferably at an acute angle transverse to the stranded wires, around the bundle of conductors and the shield sleeve before the sheath tape is applied in the same manner to the foil shield. In principle, the shield tape can be brought together with the sheath tape with a slight lateral overlap before the shield sleeve and the bundle of conductors are simultaneously wrapped by said tapes.

The shield tape may include a single metal, for example aluminum, a metal composite, for example galvanized copper, or a plastic-and-metal laminate, and is wrapped spiral-like along the stranded wires around the bundle of conductors and around the shield sleeve. In order to ensure sufficient flexibility of the connecting cable, the edges of the shield tape preferably overlap narrowly from one turn to the next. In this way, not only the electrical cable but also the plug connector are shielded sufficiently, especially at the transition between the bundle of conductors and its metallic housing. The shielding produced in this way essentially prevents a signal loss, interference through reception of outside signals, and interference with the environment due to emission of signals to the outside. A 100% shielding of the stranded wires and of the electrical contacts connected with the stranded wires is achieved.

In general, the electrical connecting cable with the plug connector at one end of the electrical cable may include at its other end, i.e. the end of the electrical cable opposite the plug connector, either free stranded wire ends with or without attached contact elements, an unshielded group plug of any type, or a shieldable second plug connector of preferably similar design as the first plug connector. It is clear that in the case of two plug connectors of shieldable design, the cable shield and the protective sheath that are formed by the wrappings of the shield tape and of the sheath tape, respectively, each overlap the shield sleeves of the two metallic round housings. In each case, the foil shield contacts the at least one metallic round housing at the shield sleeve with low electrical contact resistance and forms a hose-like foil shield composed of the windings of the shield tape. The protective sheath of the connecting cable that is wound by the sheath tape forms a hose-like protective jacket that protects the foil shield against damage and electrical contact from outside. Also, the protective sheath compresses the bundle of conductors with the foil shield in the area of the stranded wires and the foil shield in the area of the shield sleeve that is molded onto the metallic round housing.

The sheath tape may be made of any flexible material and is ideally significantly thicker than the shield tape. It is electrically non-conductive and overlaps the foil shield over its full length in a similar way as the shield tape overlaps the bundle of conductors and the shield sleeve. Ideally, the sheath tape is extremely wear and tear resistant, and is preferably glued to the foil shield. In a preferred embodiment of the invention, the shield tape is also glued to the bundle of conductors and the shield sleeve. The sheath tape may consist, for example, of a plastic foil or a fabric made of plastic threads and/or textile fiber threads, or of some other suitable material. Like the shield tape, the sheath tape is wound spiral-like with a lateral overlap in the extension direction of the stranded wires around the foil shield. The sheath tape that is wound at an angle along the shield tape with laterally overlapping edges has the effect of imparting a certain flexural stiffness to the electrical connecting cable according to the invention, depending on the lateral overlap. Preferably, the edges of the sheath tape overlap widely from one turn to the next. Here, 'wide' means an overlap of at least one quarter or more of the tape width of the sheath tape. In contrast, it is stated above that the lateral overlap of the shield tape is preferably small, which means that the edges of this tape overlap less than the edges of the sheath tape. In principle, however, the lateral overlap of the shield tape and of the sheath tape may be selected as desired. The width of the shield tape and of the sheath tape may be selected as desired, and independently of each other.

The gluing of the shield tape and/or the sheath tape is effected by means of a suitable adhesive that is applied to the insulated stranded wires, the shield sleeve, the shield tape, and/or the sheath tape. The adhesive may be applied in the form of dots, as a bead, or as a layer either in advance and/or during the spiral-like wrapping of the stranded wires or of the bundle of conductors and/or the foil shield. Preferably, a shield tape and/or a sheath tape are used with an adhesive coating that has advantageously been applied in advance, rendering the shield tape and/or the sheath tape self-adhesive.

For an efficient production and a low flexural stiffness of the proposed electrical connecting cable it proved to be advantageous to wind the shield tape and the sheath tape in the same direction. It is also advantageous to start the winding at the same place. It proved to be especially advantageous to wind the shield tape and the sheath tape spiral-like, starting at the shield sleeve. By starting the winding of the shield tape at the shield sleeve, each successive turn overlaps the previous one so that the shield tape cannot become detached from the shield sleeve unintentionally. The same is true for the sheath tape that protects the windings of the foil shield and also positively prevents a detachment of the foil shield from the shield sleeve especially in the area of the shield sleeve. In the area of transition between the shield tape and the shield sleeve, the sheath tape acts as bending protection that can be further improved in this area by wrapping the sheath tape multiple times around the foil shield in the area of transition between the shield tape and the shield sleeve.

In summary, it may be stated that the production of the electrical connecting cable according to the invention is distinctly less material- and labor-intensive than the prior art, and therefore much more cost-efficient.

Below, the invention is explained in detail with reference to an embodiment shown schematically in the drawing. Additional characteristics of the invention are given in the following description of the embodiment of the invention in conjunction with the claims and the attached drawing. The individual characteristics of the invention may be realized either individually by themselves or in combinations of several in different embodiments of the invention. The single FIGURE of the drawing shows a side view of an electrical connecting cable according to the invention, comprising a flexible electrical cable and an electrical plug connector at one end of the cable.

BRIEF DESCRIPTION OF THE DRAWING

FIG. 1 illustrates an electrical connecting cable in accordance with an embodiment of the invention.

DETAILED DESCRIPTION OF THE INVENTION

The drawing shows the electrical connecting cable 1 according to the invention with a flexible electrical cable 2 and a plug connector 4 arranged at a first end 3 of the cable 2 in an extended state. However, since the cable 2 has limited flexural stiffness, it can be routed as desired, in principle. The cable 2 comprises a bundle of conductors 5 of insulated stranded wires 6, a foil shield 7 enclosing the bundle of conductors 5, and a protective sheath 8 encasing the foil shield 7 and serving as outer surface of the cable 2. As plug connector housing 9, the plug connector 4 comprises a round metallic housing holding insulated contacts (not shown) and a shield sleeve that is molded onto the round housing 9 and with which the stranded wires 6 and the foil shield 7 are connected in an electrically conductive way.

The foil shield 7 is formed by a plurality of consecutive windings 11 of a shield tape 12, and the protective sheath 8 is formed by a number of windings 13 of a sheath tape 14. The shield tape 12 and the sheath tape 14 are wrapped at an angle with a lateral overlap along the stranded wires 6 around the bundle of conductors 5 and the shield sleeve 12. The protective sheath 8 overlaps the foil shield 7 over its entire length. In order to make the foil shield 7, arranged under the protective sheath 8, visible, the drawing shows the sheath tape 14 not wrapped completely around the shield tape 12.

Opposite the plug connector 4, the other, second end 15 of the electrical cable 2 comprises free ends 16 of the stranded wires 6. Accordingly, the foil shield 7 and the protective sheath 8 surrounding the foil shield 7 on the outside end before the second end 15 of the electrical cable 2. Instead of the free ends 16 of the stranded wires 6, the electrical cable 2 may also comprise an electrical plug connector of any type at its second end 15.

The shield tape 12 is glued to the bundle of conductors 5 and the shield sleeve 10, and the sheath tape 14 is glued to the foil shield 7 formed by the shield tape 12. For this purpose, the shield tape 12 and the sheath tape 14 preferably comprise an adhesive layer (not shown). Preferably, the shield tape 12 and the sheath tape 14 are self-adhesive. The self-adhesive shield tape 12 and the self-adhesive sheath tape 14 permit a simple wrapping of the bundle of conductors 5 and the foil shield 7. In addition, this also permits the protective sheath 8 forming the outer surface of the cable 2 to be wound in the same winding process and preferably in one process step with the foil shield 7. In this embodiment, the shield tape 12 and the sheath tape 14 are wound in the same direction in order to achieve the highest possible flexibility of the cable 2. In addition, the shield tape 12 and the sheath tape 14 are both wound starting at the shield sleeve 10 of the round housing 9.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

The invention claimed is:

1. An electrical connecting cable with a flexible electrical cable and with at least one electrical plug connector at one end of the cable, with the electrical cable comprising a bundle of conductors consisting of insulated stranded wires, a foil shield enclosing the bundle of conductors, and a protective sheath encasing the foil shield and serving as the outer surface of the cable, and with the plug connector comprising a metallic plug connector housing holding insulated contacts and a molded-on shield sleeve with which the stranded wires and the foil shield are connected in an electrically conductive manner, wherein the foil shield comprises at least one electrically conductive shield tape which is wrapped at an angle spiral-like along the bundle of wire conductors and the shield sleeve with lateral overlap, and the protective sheath comprises at least one electrically non-conductive sheath tape which is wrapped along the foil shield around the shield tape and the shield sleeve at an angle spiral-like with lateral overlap and wherein the protective sheath overlaps the foil shield over its entire length, so that the protective sheath presses the foil shield against the shield sleeve and wherein the shield tape is glued to the shield sleeve and/or the sheath tape is glued to the foil shield formed by the shield tape.

2. The connecting cable according to claim 1, wherein the shield tape is glued to the bundle of conductors and the shield sleeve and/or that the sheath tape is glued to the foil shield formed by the shield tape.

3. The connecting cable according to claim 2, wherein the shield tape and/or the sheath tape comprise a layer of adhesive.

4. The connecting cable according to claim 1, wherein the shield tape and the sheath tape are wound in the same direction.

5. The connecting cable according to claim 1, wherein the shield tape and/or the sheath tape are wound starting at the shield sleeve.

6. The connecting cable according to claim 1, wherein the metallic plug connector housing is a round housing.

* * * * *